US005531589A

United States Patent [19]

Williams

[11] Patent Number: 5,531,589

[45] Date of Patent: Jul. 2, 1996

[54] FUEL CONTROL SYSTEM, CONTROL DEVICE THEREFOR AND METHODS OF MAKING AND OPERATING THE SAME

[75] Inventor: Kurt T. Williams, Holland, Mich.

[73] Assignee: Robertshaw Controls Company, Richmond, Va.

[21] Appl. No.: 194,244

[22] Filed: Feb. 10, 1994

[51] Int. Cl.[6] ..... F23N 5/20

[52] U.S. Cl. ..... 431/6; 431/18; 137/595; 251/129.15

[58] Field of Search ..... 431/18, 6, 31, 431/46, 70, 74, 71; 137/595; 251/129.15

[56] References Cited

U.S. PATENT DOCUMENTS 4,641,778 2/1987 Dodson ..... 236/20 R
4,787,414 11/1988 Kelly et al. ..... 137/595
5,209,655 5/1993 Geary ..... 431/6

*Primary Examiner*—Larry Jones
*Attorney, Agent, or Firm*—Fulbright & Jaworski

[57] ABSTRACT

A fuel control system, a control device therefor and methods of making and operating the same are provided, the fuel control system comprising a source of fuel a burner unit, an electrically operated valve unit adapted to be opened to interconnect the source of fuel to the burner unit when the valve unit is energized, the valve unit having a coil, an electrical power source having a value sufficient for opening the valve unit when operatively interconnected to the coil to energize the coil, a control device for operatively interconnecting the power source to the coil when the control device determines that fuel should be directed to the burner unit, the control device being so constructed and arranged that the control device is adapted to operatively interconnect the power source to the coil without the use of relay contacts between the power source and the coil.

20 Claims, 8 Drawing Sheets

FIG. 2A
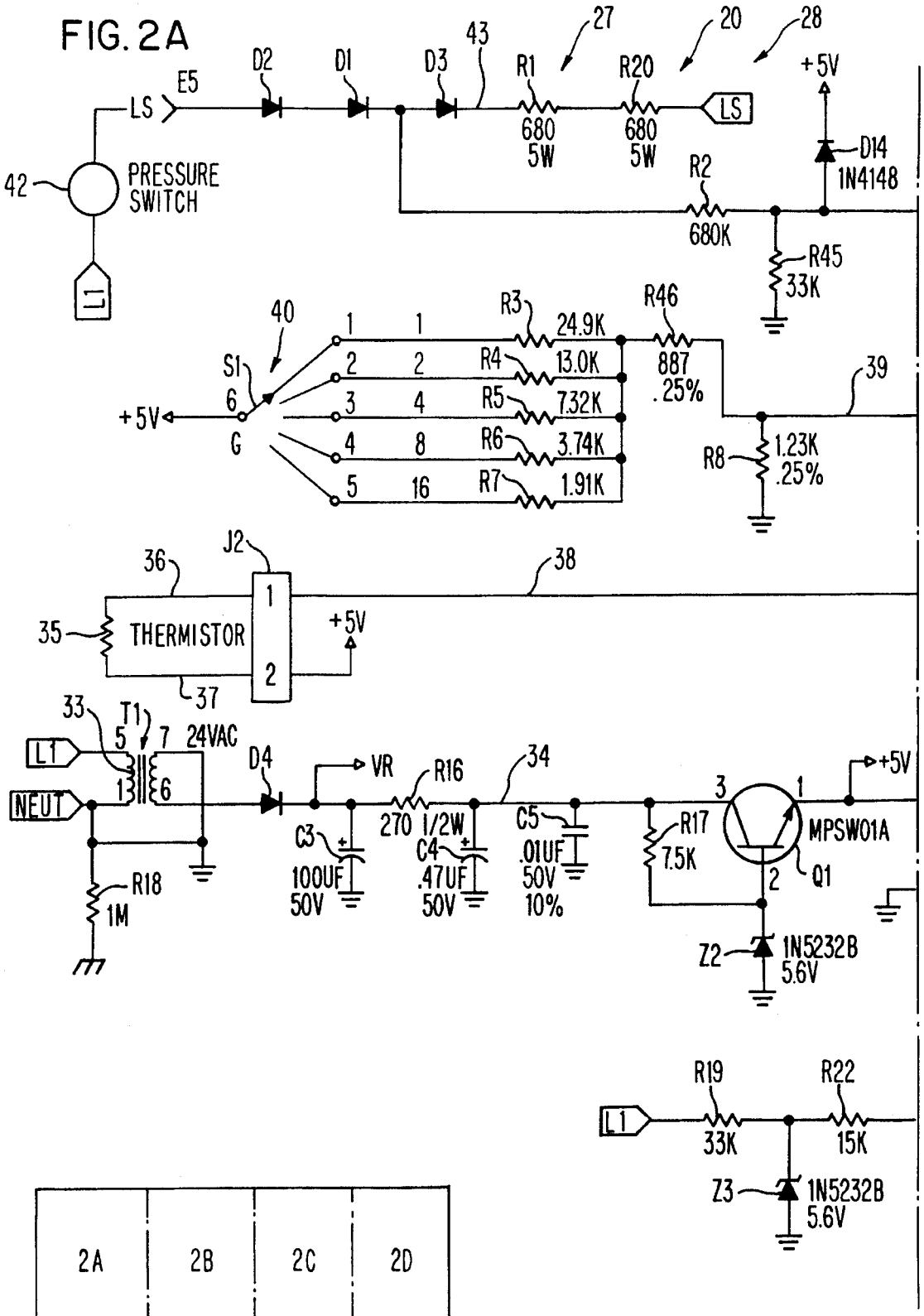
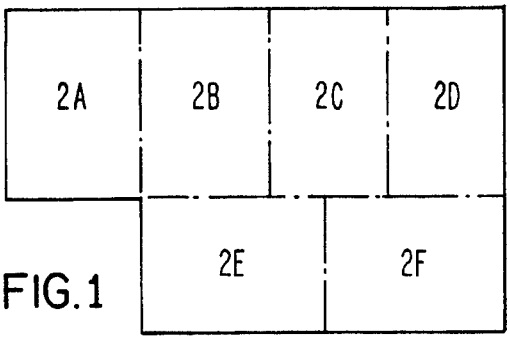
FIG. 1

29
U1
NM155202
P13
14
P01
8
44
P02
9
AD4
19
P03
10
P10
11
P11
12
SBI\
4
XI
16
P2
8
P1
8
P2
13
P1
13
P2
11
P1
11
P2
12
P1
12
R25
10K
C12
.47UF 35V
D10
1N4148
D9
1N4148
C13
.47UF
35V
R32
47K
P2
1
P1
1
P2
10
P1
10
P2
18
P1
18
P2
4
P1
4
+5V
R39
10M
Q6
R41
1.5K
R42
7.5K
R40
330K
2N2907A

VR
D5
K1A
Q2
MPSA27
E3
GROUND
E2
INDUCER
41
K1B
E1
L1
30
31
FUEL SOURCE
23
LS
43
C10
47UF
200V
D6
48
49
26
53
Q8
STP5N30
52
45
J3
J4
ECO
44
D7
55
C11
33UF
J6
MAIN
VALVE
J7
24
51
56
R30
100
1W
54
50
Q9
2N2222A
22
21
BURNER
WATER HEATER
R31
100K
C18
.01UF
IGNITOR
5
6
K2A
D11
R33
100K
Q4
MPSA27
Q5
MPSA27
+5V
D12
1N4148
R38
160K
R35
51K
25
E10
FLAME
IGNITOR
K2B
E9
32
NEUT
NEUTRAL

61

| 69 R7 | 68 R6 | 67 R5 | 66 R4 | 65 R3 | 62 | 63 SET POINT TEMPERATURE | 64 VOLTAGE SET POINT | 70 ACTUAL TEMPERATURE | 71 VOLTAGE THERMISTOR |
|---|---|---|---|---|---|---|---|---|---|
| 0 | 0 | 0 | 0 | 0 | 0 | – | – | – | – |
| 0 | 0 | 0 | 0 | 1 | 1 | 46 | 0.23 | – | – |
| 0 | 0 | 0 | 1 | 0 | 2 | 57 | 0.41 | – | – |
| 0 | 0 | 0 | 1 | 1 | 3 | 68 | 0.58 | 48.4 | 0.26 |
| 0 | 0 | 1 | 0 | 0 | 4 | 77 | 0.66 | 75.6 | 0.68 |
| 0 | 0 | 1 | 0 | 1 | 5 | 83 | 0.80 | – | – |
| 0 | 0 | 1 | 1 | 0 | 6 | 90 | 0.91 | 87.33 | 0.86 |
| 0 | 0 | 1 | 1 | 1 | 7 | 100 | 1.02 | 97.20 | 1.02 |
| 0 | 1 | 0 | 0 | 0 | 8 | 102 | 1.06 | 99.24 | 1.05 |
| 0 | 1 | 0 | 0 | 1 | 9 | 108 | 1.15 | 105.5 | 1.15 |
| 0 | 1 | 0 | 1 | 0 | 10 | 112 | 1.23 | 109.8 | 1.22 |
| 0 | 1 | 0 | 1 | 1 | 11 | 117 | 1.31 | 115.13 | 1.30 |
| 0 | 1 | 1 | 0 | 0 | 12 | 120 | 1.35 | 118.38 | 1.35 |
| 0 | 1 | 1 | 0 | 1 | 13 | 123 | 1.42 | 121.63 | 1.40 |
| 0 | 1 | 1 | 1 | 0 | 14 | 127 | 1.47 | 125.97 | 1.47 |
| 0 | 1 | 1 | 1 | 1 | 15 | 129 | 1.53 | 128.1 | 1.50 |
| 1 | 0 | 0 | 0 | 0 | 16 | 130 | 1.54 | 129.2 | 1.52 |
| 1 | 0 | 0 | 0 | 1 | 17 | 133 | 1.59 | 132.4 | 1.57 |
| 1 | 0 | 0 | 1 | 0 | 18 | 136 | 1.63 | 135.7 | 1.62 |
| 1 | 0 | 0 | 1 | 1 | 19 | 139 | 1.68 | 138.8 | 1.67 |
| 1 | 0 | 1 | 0 | 0 | 20 | 140 | 1.70 | 139.9 | 1.69 |
| 1 | 0 | 1 | 0 | 1 | 21 | 143 | 1.74 | 143.0 | 1.73 |
| 1 | 0 | 1 | 1 | 0 | 22 | 145 | 1.78 | 145.1 | 1.77 |
| 1 | 0 | 1 | 1 | 1 | 23 | 147 | 1.82 | 147.2 | 1.80 |
| 1 | 1 | 0 | 0 | 0 | 24 | 148 | 1.83 | 148.2 | 1.82 |
| 1 | 1 | 0 | 0 | 1 | 25 | 150 | 1.86 | 150.2 | 1.85 |
| 1 | 1 | 0 | 1 | 0 | 26 | 152 | 1.89 | 152.2 | 1.88 |
| 1 | 1 | 0 | 1 | 1 | 27 | 154 | 1.92 | 154.2 | 1.91 |
| 1 | 1 | 1 | 0 | 0 | 28 | 155 | 1.93 | 155.3 | 1.92 |
| 1 | 1 | 1 | 0 | 1 | 29 | 156 | 1.96 | 156.2 | 1.94 |
| 1 | 1 | 1 | 1 | 0 | 30 | 158 | 1.99 | 158.1 | 1.97 |
| 1 | 1 | 1 | 1 | 1 | 31 | 160 | 2.01 | 160.0 | 2.00 |

FIG.4

FUEL CONTROL SYSTEM, CONTROL DEVICE THEREFOR AND METHODS OF MAKING AND OPERATING THE SAME

BACKGROUND OF THE INVENTION

1. Field of the Invention

This invention relates to a new fuel control system and to a new fuel control device for such a system as well as to new methods of making and operating such a new fuel control system and such a new fuel control device.

2. Prior Art Statement

It is known to provide a fuel control system comprising a source of fuel, a burner means, and an electrically operated valve means adapted to be opened to interconnect the source of fuel to the burner means when the valve means is energized, the valve means having coil means, an electrical power source having a value sufficient for opening the valve means when operatively interconnected to the coil means to energize the coil means, a control means having interconnecting means for operatively interconnecting the power source to the coil means when the control means determines that fuel should be directed to the burner means, the control means being so constructed and arranged that the interconnecting means is adapted to operatively interconnect the power source to the coil means through the use of relay contact means disposed between the power source and the coil means. For example, see the Dodson U.S. Pat. No. 4,641,778.

It is also known to utilize a transistor means and two capacitors in a manner to charge the capacitors thereof on the positive half cycle of an AC signal and to discharge the capacitors during the negative half cycle of that AC signal so that a relay coil will be continuously energized. For example, see the Geary U.S. Pat. No. 5,209,655.

Also see this Geary U.S. Pat. No. 5,209,655 for an electrical system that ignites fuel that issues from a burner means.

Also see the Kelly et al U.S. Pat. No. 4,787,414 for a burner valve means that has a coil means that opens the valve means to direct fuel from a fuel source to a burner means when the coil means is energized.

SUMMARY OF THE INVENTION

It is one of the features of this invention to provide a new fuel control system wherein the coil means of an electrically operated valve means is interconnected to a power source to energize the coil means and thereby open the valve means without the use of relay contact means between the electrical power source and the coil means.

In particular, it was found according to the teachings of this invention that while prior known fuel control systems each utilize relay contact means between an electrical power source and the coil means of the fuel control valve means so that the control means must energize a coil means of the relay means in order to close the contact means and thus interconnect the electrical power source to the coil means of the valve means, such relay contact means can be eliminated and the electrical power source can be, in effect, directly interconnected to the coil means of the valve means to energize the same when the control means determines that fuel should issue from the burner means.

For example, one embodiment of this invention comprises a fuel control system comprising a source of fuel, a burner means, an electrically operated valve means adapted to be opened to interconnect the source of fuel to the burner means when the valve means is energized, the valve means having coil means, an electrical power source having a value sufficient for opening the valve means when operatively interconnected to the coil means to energize the coil means, a control means having interconnecting means for operatively interconnecting the power source to the coil means when the control means determines that fuel should be directed to the burner means, the control means being so constructed and arranged that the interconnecting means is adapted to operatively interconnect the power source to the coil means without the use of relay contact means between the power source and the coil means.

Accordingly, it is an object of this invention to provide a new fuel control system having one or more of the novel features of this invention as set forth above or hereinafter shown or described.

Another object of this invention is to provide a new method of making such a control system, the method of this invention having one or more of the novel features of this invention as set forth above or hereinafter shown or described.

Another object of this invention is to provide a new method of operating such a control system, the method of this invention having one or more of the novel features of this invention as set forth above or hereinafter shown or described.

Another object of this invention is to provide a new fuel control device for such a fuel control system, the fuel control device of this invention having one or more of the novel features of this invention as set forth above or hereinafter shown or described.

Another object of this invention is to provide a new method of making such a fuel control device, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

BRIEF DESCRIPTION OF THE DRAWINGS

FIG. 1 is a schematic view illustrating how FIGS. 2A, 2B, 2C, 2D, 2E and 2F are to be positioned relative to each other in order to illustrate the entire fuel control system of this invention.

FIG. 2A illustrates one part of the fuel control system of this invention and is adapted to be arranged in the manner illustrated in FIG. 1 with the other FIGS. 2B–2F to provide the entire fuel control system of this invention.

FIG. 2B illustrates another part of the fuel control system of this invention.

FIG. 2C illustrates another part of the new fuel control system of this invention.

FIG. 2D illustrates another part of the new fuel control system of this invention.

FIG. 2E illustrates another part of the new control system of this invention.

FIG. 2F illustrates another part of the new fuel control system of this invention.

FIG. 4 is a chart showing the various selected positions of the set point temperature selector means of the system and how the same interconnects certain resistors together to produce a set point voltage signal and comparing that setting to the actual temperature being sensed by a thermistor means of the system and the voltage signal produced by the thermistor means at the particular temperature sensed thereby.

DESCRIPTION OF THE PREFERRED EMBODIMENT

Figure 2B:
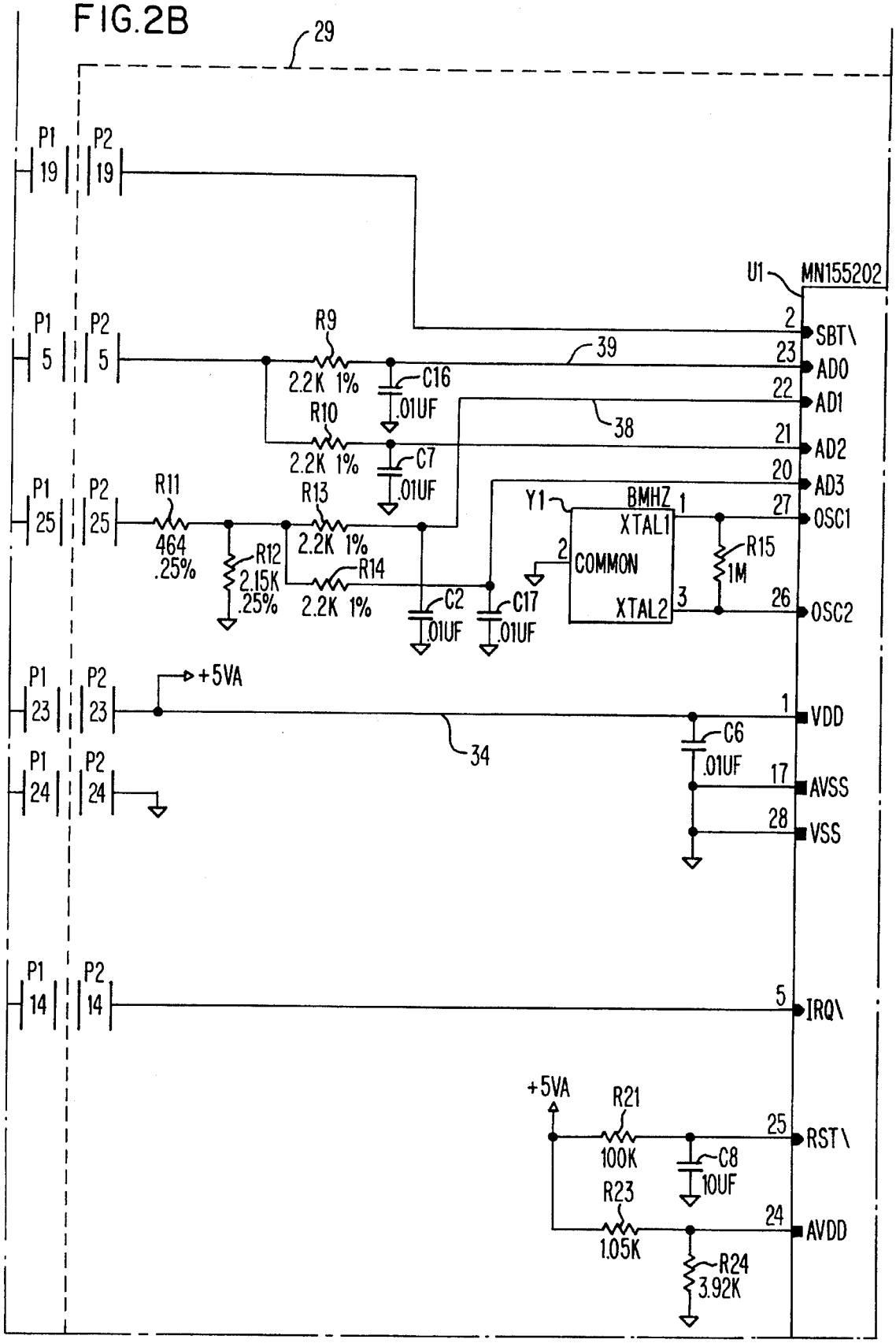

While the various features of this invention are hereinafter illustrated and described as being particularly adapted to provide a fuel control system for a water heater, it is to be understood that the various features of this invention can be utilized singly or in various combinations thereof to provide a fuel control system for other apparatus or appliances as desired.

Therefore, this invention is not to be limited to only the embodiment illustrated in the drawings, because the drawings are merely utilized to illustrate one of the wide variety of uses of this invention.

Figure 2C:
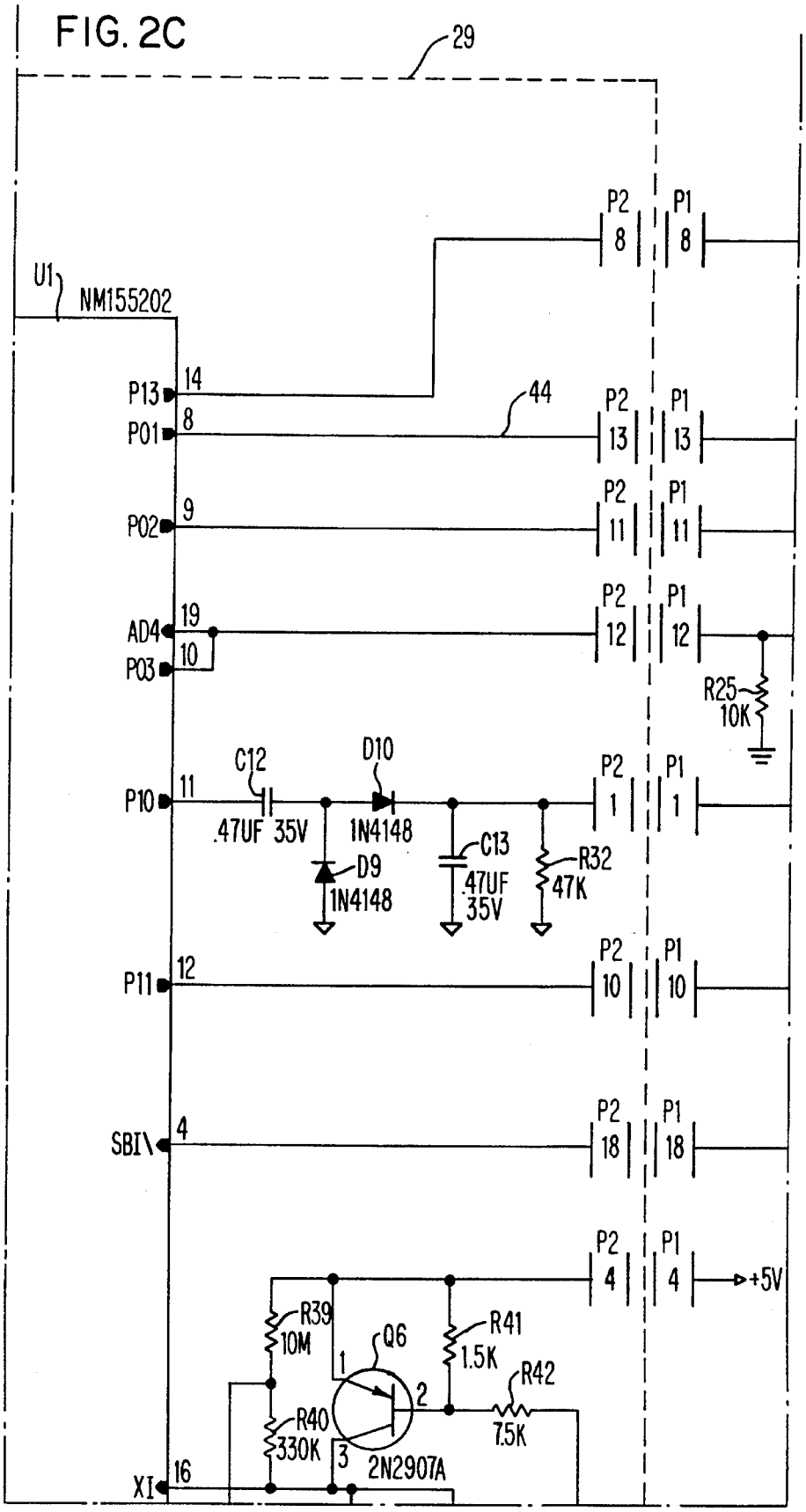
Figure 2D:
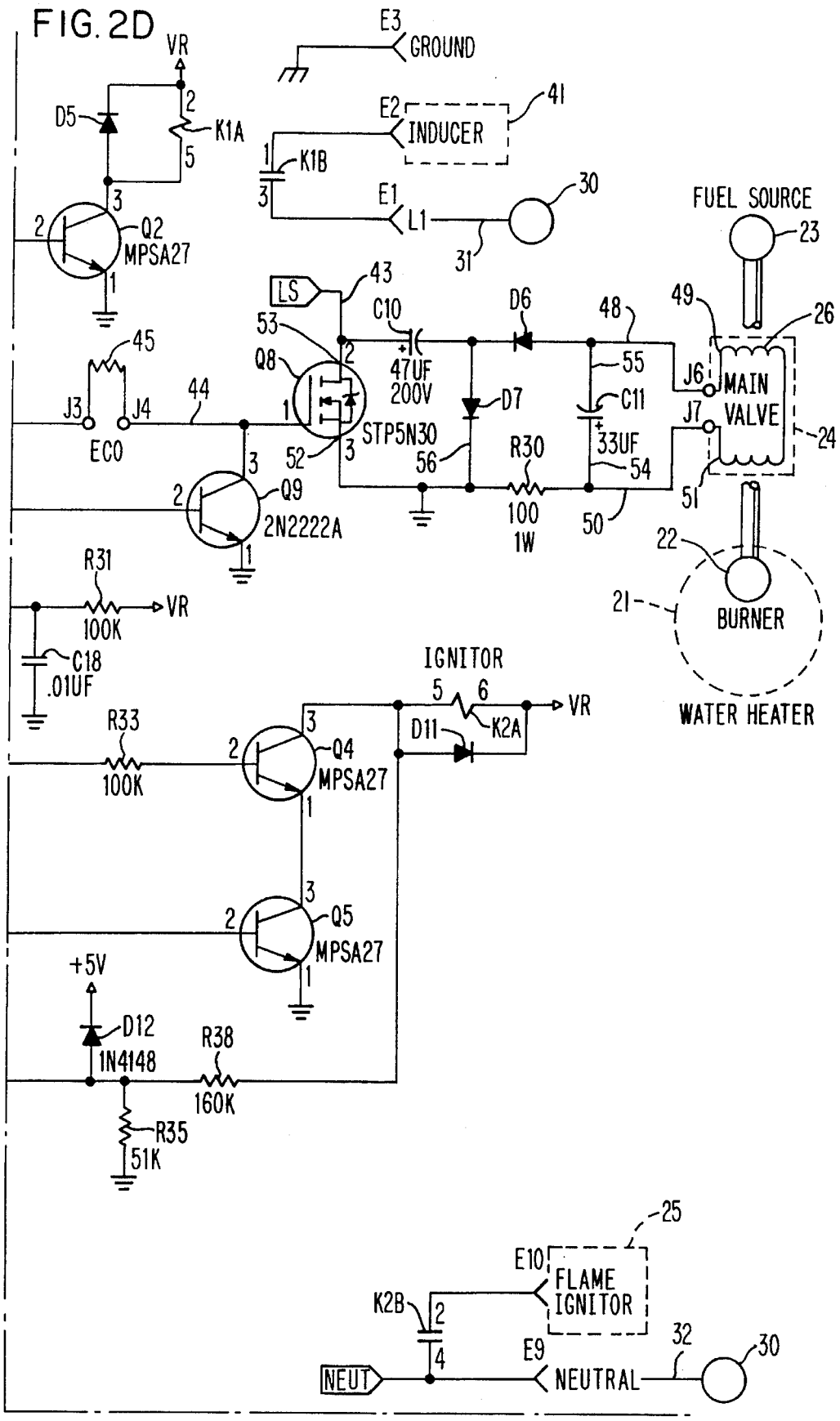

Referring now to the drawings, the new fuel control system of this invention is generally indicated by the reference numeral 20 and comprises the structure illustrated in FIGS. 2A–2F that are to be placed together in the manner illustrated in FIG. 1, the fuel control system 20 being utilized to control the operation of a water heater that is schematically illustrated by the dashed circle 21 in FIG. 2D.

As illustrated in FIG. 2D, the water heater 21 is adapted to have the water contained therein heated by a burner means or heat exchanger means 22 when the burner means 22 is fed fuel from a fuel source 23 through an opened main electrically operated valve means 24 and has been ignited by an electrically operated igniter means 25 also illustrated in FIG. 2D in a manner well known in the ignition art. For example, see the aforementioned Geary U.S. Pat. No. 5,209,655, as well as other Geary U.S. Pat. Nos. 4,836,770; 4,856,983; 4,971,549 and 4,976,605, whereby these five U.S. patents to Geary are being incorporated into this disclosure by this reference thereto.

The valve means 24 has electrical coil means 26, FIG. 2D, which when sufficiently energized will open the valve means 24 to interconnect the fuel source 23 to the burner means 22 and when the coil means 26 is deenergized, the valve means 24 will close and terminate the flow of fuel from the fuel source 23 to the burner means 22. Such general operation of an electrically operated valve means 24 is well known in the art. For example, see the aforementioned Kelly et al U.S. Pat. No. 4,787,414 whereby this U.S. patent is also being incorporated into this disclosure by this reference thereto.

The fuel control system 20 of this invention comprises a control means or control device that is generally indicated by the reference numeral 27 in the drawings and has a plurality of terminals designated with a capital E followed by a number for interconnecting to parts of the fuel control system 20 that are external to the control means or control device 27.

The control means or control device 27 comprises an electrical circuit means that is generally indicated by the reference numeral 28 in the drawings, the electrical circuit means 28 comprising a plurality of electrical lines or printed circuits and electrical components that are mounted on one or more circuit boards in a conventional manner and being electrically interconnected by the electrical lines or printed circuits as illustrated.

In particular, the circuit means 28 comprises a first circuit board represented by a dashed box 29 in the drawings which is interconnected to an outer circuit board (not shown) at cooperating pins designated with a capital P and a number following the same as illustrated in FIGS. 2B and 2C.

Since the electrical lines and the various components of the electrical circuit means 28 of this invention are parts that are well known in the art, only the components and electrical lines believed necessary to fully understand the various features of this invention will be hereinafter specifically mentioned. However, it can be seen that the various components of the electrical circuit means 27 of this invention are respectively given reference characters that are common in the art to represent the components, such as a capital C for a capacitor, a capital R for a resistor, a capital D for a diode, a capital Q for a transistor, etc. with each capital letter thus being followed by a particular number to distinguish that particular reference letter from the others for similar components. In addition, unless otherwise specified on the drawings, all resistance values given on the drawings are in ohms, 0.25 Watt +/–5%; all capacitor values are 50 V. +/–20% and all diodes are 1N4004.

The control device 27 comprises a microprocessor or microcomputer U1 that is programmed in a manner well known in the art to function in a manner hereinafter set forth.

Figure 2E:
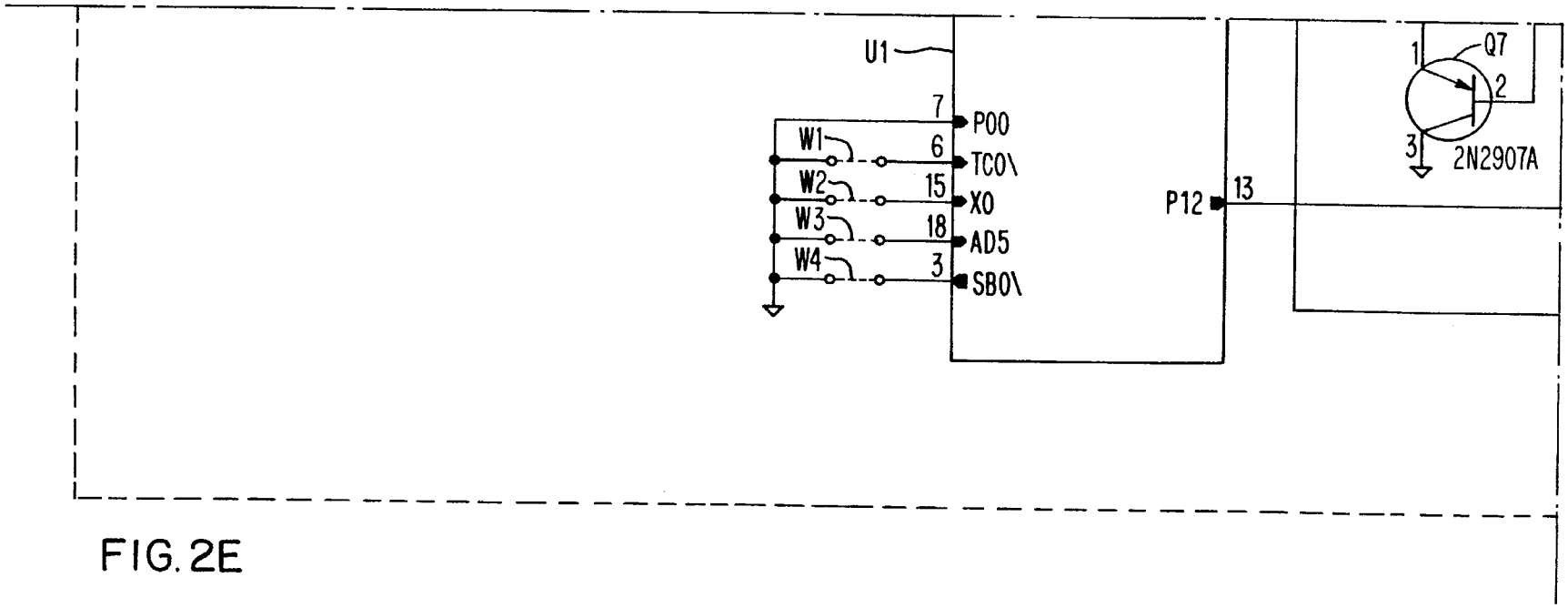
Figure 2F:
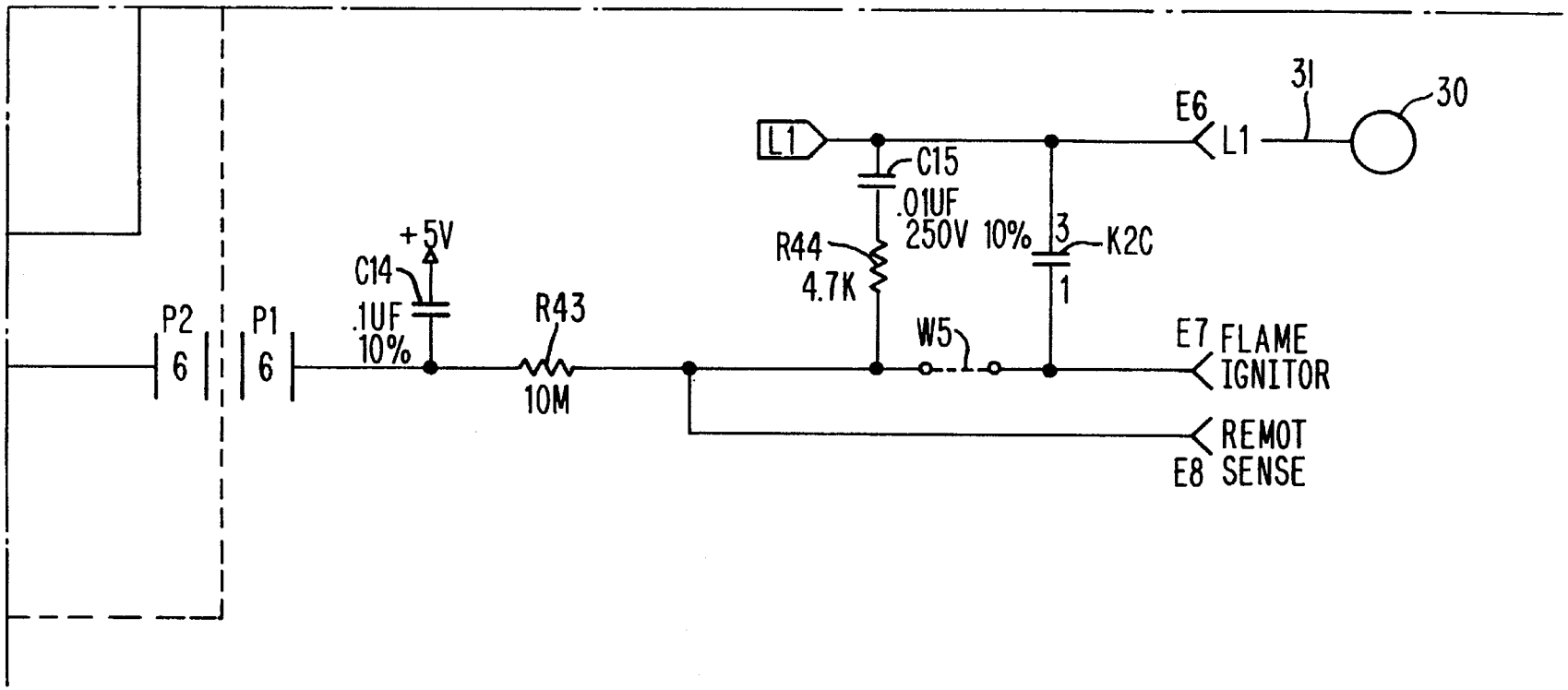

The system 20 comprises an electrical power source 30 that provides a 120 volt alternating current by an L1 line 31 and a Neutral N line 32 that are adapted to be respectively interconnected to the circuit means 28 at the terminals E1, E6 and E9 as illustrated in FIGS. 2D and 2F. Such power source lines 31 and 32 are interconnected to a primary coil 33 of a transformer T1 which drops the voltage to 24 volts AC in a conventional manner and supplies through an electrical line 34 power VDD to pin 1 of the microcomputer U1 in a manner well known in the art, the line 34 also producing a positive 5 volt supply at a point intermediate a transistor means Q1 and the microcomputer U1 which is utilized throughout the circuit means 28 in the manner illustrated in the drawings.

In particular, a thermistor 35 of the system 20 has opposite sides 36 and 37 thereof interconnected to the pins 1 and 2 of a jack J2 whereby the positive 5 volt supply is interconnected to the side 37 of the thermistor 35 and the side 36 thereof is interconnected by a line 38 of the circuit means 28 to pin 22 of the microcomputer U1, the line 38 having resistors R11 and R12 therein which linearize the voltage signal created by the thermistor 35 before the same reaches the microcomputer U1 so that as the temperature sensed by the thermistor 35 increases, the voltage signal being received by the microcomputer U1 likewise increases in a manner hereinafter set forth and in a generally straight line manner.

The thermistor 35 is so constructed and arranged that the same is adapted to sense the temperature of the water in the water heater 21 in a manner well known in the art. For example, see the aforementioned Dodson U.S. Pat. No. 4,641,778 whereby this U.S. patent is also being incorporated into this disclosure by this reference thereto.

In one working embodiment of this invention, the thermistor 35 is disposed in a sealed tube extension of a shank portion of the control device with the tube extension being disposed in the water in the water heater 21 in a manner similar to a rod and tube temperature sensor.

The linearization of the out voltage from the thermistor 35 is uniquely matched by a set point voltage signal produced in a line 39 of the circuit means 28 under the control of a thirty-two position binary coded encoder means or selector means that is generally indicated by the reference numeral 40 in FIG. 2A and five resistors R3, R4, R5, R6 and R7 that are interconnected in various combinations thereof to the plus 5 volt supply by movable switch means S1 of the binary coded encoder means 40 in a manner hereinafter set forth.

However, in general, the operator sets the rotatable knob (not shown) of the binary coded encoder means 40 at a desired selected water temperature that the control device 27 is to tend to maintain in the water heater 21 and when the temperature of that water falls below the selected set point temperature a certain amount, the microcomputer U1 will cause the coil means 26 of the valve means 24 to be energized so as to interconnect the fuel source 23 to the burner means 22 and be ignited by the igniter means 25 so as to heat up the water in the water heater 21 until the same reaches the selected set point temperature. At this time, the microcomputer U1 will then deenergize the coil means 26 of the valve means 24 to terminate the flow of fuel to the burner means 22, the microcomputer U1 determining the temperature of the water in the water heater 21 based upon the electrical voltage signal being directed to the microcomputer U1 by the thermistor 35 through the line 38 as previously set forth and comparing that voltage signal with the set point voltage signal being directed thereto through the line 39 at the particular setting of the selector means 40.

The system 20 has air flow creating means (not shown) to clear away the combustion products of the burner means 22 in a manner well known in the art, such air flow creating means comprising an inducer motor 41, FIG. 2D, which must be operating sufficiently before the system 20 will permit fuel to flow to the burner means 22 as is also well known in the art.

In particular, the inducer motor 41 has a pressure switch 42, FIG. 2A, which will only close after the inducer motor 41 is turned on and is operating normally, the pressure switch 42 being adapted to interconnect the power source line L1 to the terminal E5 of FIG. 2A when the pressure switch 42 is closed so that the 120 volt alternating current is applied to a line 43 of the circuit means 28 which passes through diodes D2, D1, D3, a resistance R1 and a resistance R20 of FIG. 2A to the positive side of a capacitor C10, FIG. 2D, which will charge to the full line voltage of 120 volts as long as a transistor means Q8 is not turned on by the microcomputer U1 sending a signal thereto through line 44 at a pin 8 thereof which occurs only when the microcomputer U1 determines that the burner 22 should be turned on in a manner hereinafter set forth.

Of course, other limit switches could also be used in lieu of the pressure switch 42 or in series therewith, as desired and as is well known in the art.

The line 44 from the pin 8 of the microcomputer U1 has a thermal limiter 45 therein which is so constructed and arranged that the same senses the water temperature in the water heater 21 and will open and thereby break the line 44 between the microcomputer U1 and the transistor means Q8 if the water temperature exceeds a certain high temperature limit, such as 200° F., also in a manner well known in the art.

Figure 3:
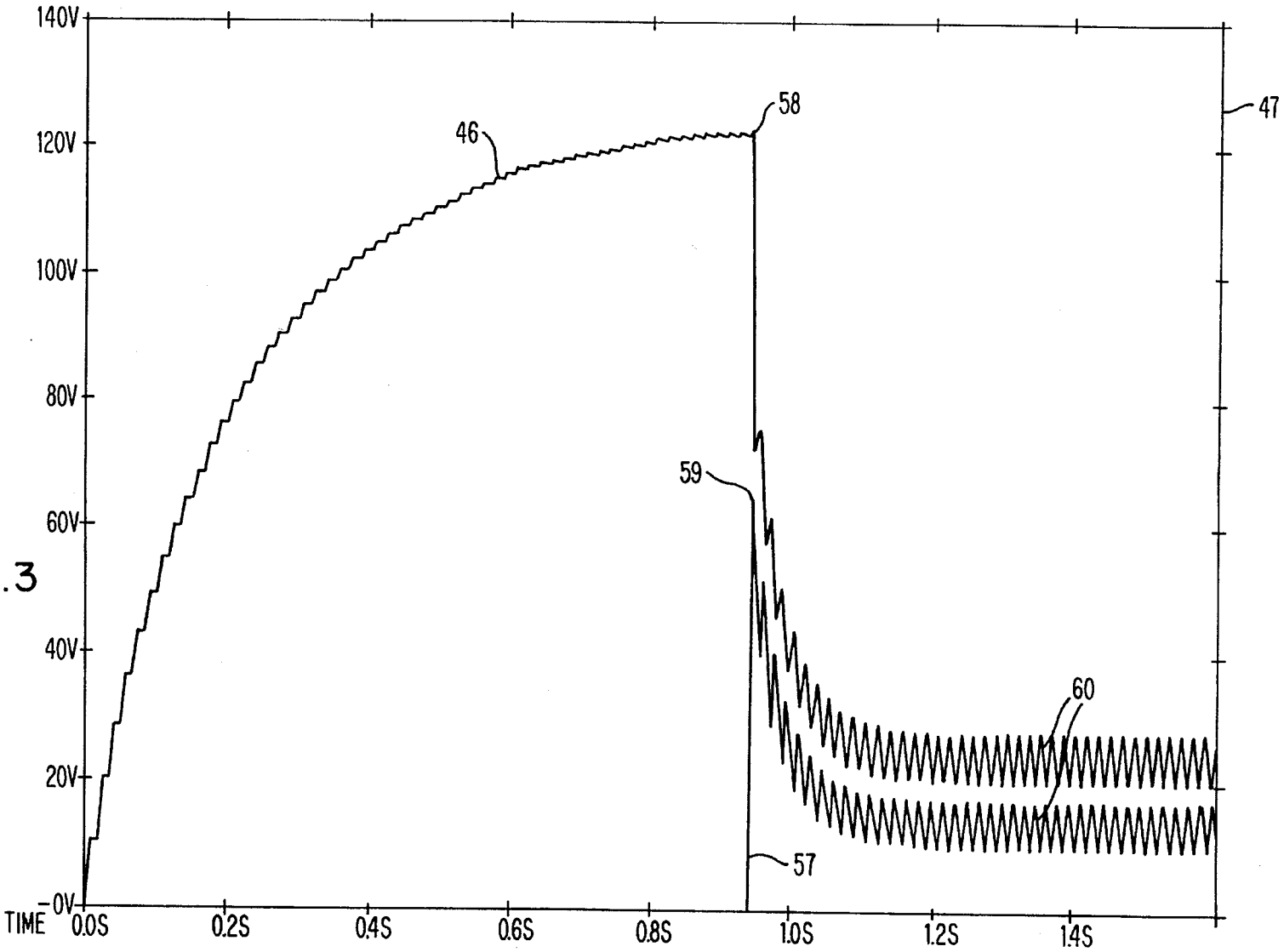
FIG. 3 is a graph that illustrates how two capacitors of the system of this invention are charged and discharged, the X axis of the graph being in seconds of time and the Y axis thereof being in volts.

As fully illustrated by a line 46 on a graph 47 in FIG. 3, the initial charging up of the capacitor C10 with the transistor means Q8 being in its off condition and with the pressure switch 42 initially being closed to interconnect L1 to terminal E5, the voltage on capacitor C10 rises to approximately 120 volts as represented by a point 58 on the line 46 of the graph 47 in less than one second.

The transistor means Q8 comprises a MOSFET which functions in a manner hereinafter set forth.

A line 48 of the circuit means 28 in FIG. 2D interconnects the negative side of the capacitor C10 to one side 49 of the coil means 26 of the valve means 24 while another line 50 of the circuit means 28 is connected to the other side 51 of the coil means 26 of the valve mean 24, the line 50 being interconnected to ground and to a side 52 of the transistor means Q8. The other side 53 of the transistor means Q8 is interconnected to the line 43 that also leads to the positive side of the capacitor C10.

A capacitor C11 has its positive side interconnected by a line 54 to the line 50 and its negative side connected by a line 55 to the line 48 while a diode D6 is disposed in the line 48 intermediate the negative sides of the capacitors C10 and C11.

A line 56 interconnects the line 48 to the line 50 and has a diode D7 therein, the line 50 having a resistor R30 intermediate the interconnection points of the lines 54 and 56 thereto as illustrated.

The charging and discharging of the capacitor C11 is represented by the line 57 on the graph 47 of FIG. 3.

Thus, when the microcomputer U1 determines that the water in the water heater 21 should be heated by turning on the burner means or heat exchanger 22 since a sensed temperature by the thermistor 35 is below the set point temperature of the selector means 40 a certain amount as will be hereinafter set forth, the microcomputer U1 either has previously turned on or now turns on the inducer 41 and when the pressure switch 42 of the inducer 41 closes, L1 is interconnected to the line 43 so that a 120 volt alternating current wave form is applied to the input E5 of the line 43 and this wave form charges up the capacitor C10 through diodes D1, D2, D3, resistors R1 and R20 and diode D7 to ground. Therefore, the charge on the capacitor C10 will eventually reach the positive peak value of the alternating current input and during this charging process, the MOSFET Q8 is in its pinch-off state. When it is time to activate the valve means 24, the microcomputer U1 turns on the transistor means Q8 by sending a signal through line 44 during the negative half cycle of the input AC wave form and this turning on of the transistor means Q8 connects the capacitor C10 to the capacitor C11 through the resistor R30 and the diode D6. This allows the capacitor C10 to transfer a portion of its charge to the capacitor C11 so that this transferred charge charges up the capacitor C11 and activates or energizes the valve coil 26. On the positive half cycle of the input AC wave form, the transistor means Q8 is turned off and the capacitor C10 recharges through the diode D7 and at the same time the capacitor C11 discharges through the valve coil 26 keeping the valve coil 26 active or energized. Also, during the positive half cycle of the input AC wave form, the diode D6 blocks the process that is charging the capacitor C10 from the discharging process of the capacitor C11. When the cycle swings negative, the process repeats itself and as long as the microcomputer U1 determines that heat should be supplied to the water heater 21, the capacitors C10 and C11 charge and discharge in the above manner to maintain the coil means 26 energized.

However, when the temperature being sensed by the thermistor 35 reaches the set point temperature of the selector means 40, the microcomputer U1 places the transistor means Q8 in its off state so that the charge that is on the capacitor C10 cannot be transferred to the capacitor C11 and the energy stored in the capacitor C11 eventually falls below the hold in energy required by the valve coil 26 so that the valve means 24 closes and terminates the flow of fuel from the fuel source 23 to the burner means 22.

Such charging and discharging of the capacitor C10 begins at the point 58 on the line 46 of the graph 47 of FIG. 3 and the initial charging up of the capacitor C11 correspondingly begins at that point 58 so that the initial charge on the capacitor C11 reaches the point 59 on the line 57 which is approximately 60 volts. Thereafter, the charging and discharging of capacitor C10 causes the discharging and charging of the capacitor C11 which combination produces an approximate average voltage that passes through the coil 26 of the valve means 24 as represented by a typical point 60 on the lines 46 and 57 and this average voltage is sufficient to maintain the coil 26 in its valve open holding condition.

In particular, the coil means 26 of the valve means 24 in one working embodiment of this invention comprises a 48 volt rated coil so that sufficient voltage is provided by the capacitors C10 and C11 on the initial energizing of such coil 26 so as to pull the coil 26 in to its energized condition and thereafter hold the coil 26 in its energized condition so that the valve means 24 will be in an open condition until the microcomputer U1 causes the transistor means Q8 to be held in its off condition as previously set forth.

Thus, it can be seen that the fuel control system 20 of this invention directly drives the electrically operated valve means 24 with line voltage by means of the capacitors C10 and C11 in combination with the transistor means Q8 without the requirement of relay contact means between the electrical power source and the coil means 26 such as is provided in the aforementioned Geary U.S. Pat. No. 5,209, 655 whereby the need for a relay means for turning on the valve means is not required by the fuel control system 20 of this invention.

However, as previously stated, it can be seen in FIG. 2E of the aforementioned patent to Geary, U.S. Pat. No. 5,209, 655 that a similar capacitor and transistor arrangement is provided therein for energizing the coil K1A of a relay means to close the contacts thereof.

Referring now to FIG. 2A, it can be seen that the selector means 40 has a rotatable switch means S1 and in one working embodiment of the system 20 comprises a thirty-two detent position binary coded encoder means manufactured and sold as part No. LCE2-32-1 by Oak Grigsby of Sugar Grove, Ill. and operates in a manner well known in the encoder art. For example, see the Slavin et al U.S. Pat. No. 4,346,269 whereby this U.S. patent is being incorporated into this disclosure by this reference thereto.

Accordingly, reference is now made to FIG. 4 wherein a chart 61 is provided and has a plurality of vertical columns 62, 63, 64, 65, 66, 67, 68, 69, 70 and 71 which are so arranged that it can be see from column 62 that the rotatable selector S1 of the binary coded encoder means 40 has a total of 32 positions beginning with a 0 or off position through a numbered position 31 each of which will provide a corresponding set point temperature as located in column 63 for the circuit means 28 and indicating in columns 65–69 which resistor means R3, R4, R5, R6, R7 are placed in series with the resistor R46 to provide a certain voltage signal as represented by column 64 and flows through line 39 to the microcomputer U1 in the manner previously described.

Column 70 of the chart 61 provides a corresponding actual temperature being sensed by the thermistor 35 when the thermistor 35 comprises a 10K +/–one degree F. thermistor manufactured and sold as part No. 103JG1G by the U.S. Sensor Corporation of Orange, Calif. and provides a voltage signal through line 38 to the microcomputer U1 as represented by the column 71 in the manner previously described.

Thus, it can be seen that by comparing the voltage signals of columns 64 and 71 for the various set point temperatures of the selector means 40, a most accurate range of linear values is provided for the higher temperature settings in columns 63 and 70 whereas a greater error between the set point temperature and the actual temperature is found at the lower temperature settings of the selector means 40. However, this is acceptable because more accuracy is desired at higher temperatures of the water in the water heater 21 than at the lower temperatures thereof.

In order to properly read the chart 61, assume that a person has turned the selector means 40 to position 20 thereof as set forth in column 62 so as to have selected a set point temperature of 140° F. The corresponding voltage signal being directed through line 39 at such position of the selector means 40 is approximately 1.70 volts as represented in column 64 and the selector means has connected the resistors R5 and R7 together in series with the resistor R46 to be divided by the resistor R8 in order to provide such voltage signal of approximately 1.70 volts that is directed to pin 23 of the microcomputer U1. When the thermistor 35 is sensing an actual temperature of approximately 139.9° F. as represented by column 70, the thermistor 35 is generating a voltage signal of approximately 1.69 volts in line 38 leading to the pin 22 of the microcomputer U1. Thus, it can be seen that the linearization being provided by the resistors R3, R4, R5, R6, R7, R46 and R8 for the selector means 40 and the resistors R11 and R12 for the thermistor 35 provide relatively accurate matching of output voltages at the higher selected set point temperatures.

Of course, the microcomputer U1 has been programmed to use such voltage signals to control the on-off operation of the burner means 22 in the manner previously described to tend to maintain the temperature of the water in the water heater 21 at the selected set point temperature.

It is preferred that this selector means S1 of the binary coded encoder means 40 be limited in the set point temperature range selection thereof by suitable stops (not shown) so that a set point temperature range of approximately 90° F. to approximately 140° F. or of approximately 90° F. to approximately 160° F. can be provided and either of these two ranges would be for residential water heater use. In contrast, a selector knob could be provided with suitable stops for providing a range of set point temperatures from approximately 90° F. to approximately 180° F. for commercial water heater use.

Of course, other temperature ranges can be provided for other uses of the control system 20, such as for controlling a gas furnace, etc.

Therefore, it can be seen that the fuel control system 20 of this invention permits the use of a binary coded encoder means 40 in combination with a thermistor means 35 to control the output temperature effect of a burner means 22 without requiring a potentiometer as provided by the fuel control system of the aforementioned Dodson U.S. Pat. No. 4,641,778.

In addition, the fuel control system 20 of this invention permits the electrical power source means 30 to be operatively interconnected to the coil means 26 of the electrically operated valve means 24 without the use of relay contact means between the power source 30 and the coil means 26 as provided by the aforementioned Geary U.S. Pat. No. 5,209,655.

Since the feature of using the binary coded encoder means 40 does not require the feature of directly driving the coil means 26 with the power source 30 and vice versa, the feature of the binary coded encoder is being claimed in the concurrently filed patent application, Ser. No. 08/194,614, filed Feb. 10, 1994, (Robertshaw Controls Company Docket No. 3506-S).

As previously stated, the fuel control system 20 of this invention could control the operation of a burner means for a furnace or for another appliance or apparatus as desired even though the fuel control system 20 of this invention has been illustrated and described as operating a burner means for a water heater.

Therefore, it can be seen that this invention not only provides a new fuel control system and new methods of making and operating the same, but also this invention provides a new fuel control device for such a system and a new method of making such a fuel control device.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. A fuel control system comprising a source of fuel, a burner means, an electrically operated valve means adapted to be opened to interconnect said source of fuel to said burner means when said valve means is energized, said valve means having coil means, an electrical power source having a value sufficient for opening said valve means when operatively interconnected to said coil means to energize said coil means, a control means for operatively and selectively interconnecting said power source to said coil means when said control means determines that fuel should be directed to said burner means, said control means comprising an interconnecting means which includes a solid state electrical circuit directly connecting said power source and said coil means.

2. A fuel control system as set forth in claim 1 and comprising a water heater, said burner means being adapted to heat the water in said water heater.

3. A fuel control system as set forth in claim 1 wherein said interconnecting means of said control means comprises a transistor means.

4. A fuel control system as set forth in claim 3 wherein said control means comprises a microprocessor.

5. A fuel control system as set forth in claim 3 wherein said power source comprises an alternating current power source.

6. A fuel control system as set forth in claim 5 wherein said power source comprises a ground line means and a current line means, said transistor means having two sides, said coil means having two sides, said interconnecting means of said control means comprising a first capacitor having two sides one side of which is interconnected to said current line means and to one side of said two sides of said transistor means and the other side of which is interconnected to one side of said two sides of said coil means, said one side of said transistor means being interconnected to said current line means and the other of said two sides of said transistor means being interconnected to said ground line means, the other side of said two sides of said coil means being interconnected to said ground line means, said interconnecting means of said control means comprising a second capacitor having two sides one side of which is interconnected to said other side of said first capacitor and the other side of which is interconnected to said ground line means, said interconnecting means of said control means comprising a diode disposed between said other side of said first capacitor and said one side of said coil means and said one side of said second capacitor.

7. A fuel control system as set forth in claim 6 wherein said alternating current power source comprises a high voltage alternating current power source of approximately 120 volts.

8. A fuel control system as set forth in claim 7 wherein said coil means has a rating of approximately 48 volts.

9. A fuel control system as set forth in claim 6 wherein said transistor means comprises a MOSFET.

10. A control device for a fuel control system comprising a source of fuel, a burner means, an electrically operated valve means adapted to be opened to interconnect said source of fuel to said burner means when said valve means is energized, said valve means having coil means, and an electrical power source having a value sufficient for opening said valve means when operatively interconnected to said coil means to energize said coil means, said control device operatively and selectively interconnecting said power source to said coil means when said control device determines that fuel should be directed to said burner means, said control device comprising an interconnecting means which includes a solid state electrical circuit directly connecting said power source and said coil means.

11. A control device as set forth in claim 10 wherein said interconnecting means of said control device comprises a transistor means.

12. A control device as set forth in claim 11 wherein said control device comprises a microprocessor.

13. A control device as set forth in claim 11 wherein said power source comprises an alternating current power source.

14. A control device as set forth in claim 13 wherein said power source comprises a ground line means and a current line means, said transistor means having two sides, said coil means having two sides, said interconnecting means of said control device comprising a first capacitor having two sides one side of which is interconnected to said current line means and to one side of said two sides of said transistor means and the other side of which has means to be interconnected to one side of said two sides of said coil means, said one side of said transistor means being interconnected to said current line means and the other side of said two sides of said transistor means being interconnected to said ground line means, the other side of said two sides of said coil means being adapted to be interconnected to said ground line means, said interconnecting means of said control device comprising a second capacitor having two sides one side of which is interconnected to said other side of said first capacitor and the other side of which is interconnected to said ground line means, said interconnecting means of said control device comprising a diode disposed between said other side of said first capacitor and said one side of said coil means and said one side of said second capacitor.

15. A control device as set forth in claim 14 wherein said alternating current power source comprises a high voltage alternating current power source of approximately 120 volts.

16. A control device as set forth in claim 15 wherein said coil means has a rating of approximately 48 volts.

17. A control device as set forth in claim 14 wherein said transistor means comprises a MOSFET.

18. A method of making a fuel control system comprising a source of fuel, a burner means, an electrically operated valve means adapted to be opened to interconnect said source of fuel to said burner means when said valve means is energized, said valve means having coil means, an electrical power source having a value sufficient for opening said valve means when operatively interconnected to said coil means to energize said coil means, a control means for operatively and selectively interconnecting said power source to said coil means when said control means determines that fuel should be directed to said burner means, said control means comprising an interconnecting means which includes a solid state electrical circuit, said method comprising the step of forming said solid state electrical circuit to directly connect said power source and said coil means.

19. A method as set forth in claim 18 wherein said system comprises a water heater, said burner means being adapted to heat the water in said water heater.

20. A method of operating a fuel control system comprising a source of fuel, a burner means, an electrically operated valve means adapted to be opened to interconnect said source of fuel to said burner means when said valve means is energized, said valve means having coil means, an electrical power source having a value sufficient for opening said valve means when operatively interconnected to said coil means to energize said coil means, a control means for operatively and selectively interconnecting said power source to said coil means when said control means determines that fuel should be directed to said burner means, said control means comprising an interconnecting means which includes a solid state electrical circuit, said method comprising the step of directly connecting said solid state electrical circuit between said power source and said coil means.

* * * * *